United States Patent [19]

Mikos

[11] Patent Number: 4,669,134

[45] Date of Patent: Jun. 2, 1987

[54] LATCH PARTICULARLY FOR AN ADJUSTABLE HEAD SECTION OF A FOLDABLE SOFA-SLEEPER FRAME

[75] Inventor: Aloysius J. Mikos, Skokie, Ill.

[73] Assignee: Leggett & Platt, Incorporated, Carthage, Mo.

[21] Appl. No.: 477,141

[22] Filed: Mar. 21, 1983

[51] Int. Cl.[4] ..... A47C 17/04

[52] U.S. Cl. ..... 5/13

[58] Field of Search ..... 5/13, 28, 29, 53 B, 5/53 D; 292/113, 106

[56] References Cited

U.S. PATENT DOCUMENTS

| | | | |
|---|---|---|---|
| 2,595,038 | 4/1952 | Woller | 5/13 |
| 2,713,505 | 7/1955 | Luger | 292/106 |
| 2,749,559 | 6/1956 | Petersen | 5/13 |
| 2,785,415 | 3/1957 | Petersen | 5/13 |
| 2,817,100 | 12/1957 | Bruin | 5/13 |
| 3,395,409 | 8/1968 | Eakins | 5/13 |
| 3,868,733 | 3/1975 | Spitz et al. | 5/13 |
| 3,984,883 | 10/1976 | Wong | 5/13 |
| 4,104,745 | 8/1978 | Pacitti | 5/13 |

*Primary Examiner*—Gary L. Smith
*Assistant Examiner*—Vinh Luong
*Attorney, Agent, or Firm*—Wood, Herron & Evans

[57] ABSTRACT

A latch is disclosed for positioning and releasably retaining articulated linkages such as the pivotally interconnected head and body section angles of a folding sofa sleeper bed frame. The latch includes a connecting link pivotally connected at one end to the body section having at its opposite end an elongated slot including a latching notch, a latch plate slidably mounted on the connecting link having an elongated slot which overlies a portion of the length the slot in the connecting link, and a pin connected to the head section angle making a lost motion connection within the connecting link and latch plate slots. The head section of the bed frame is sequentially movable from a lowered position where it is coplanar with the body section, to a ready or "latch cocked" position which exposes the latching notch in the connecting link for receiving the head section pin, to a TV position where the head section is held in a raised, angulated position with respect to the body section by the head section pin being captured in the latching notch in the connecting link, to a release position where the head section pin is released from the latching notch and the head section is movable back to its lowered position.

13 Claims, 7 Drawing Figures

LATCH PARTICULARLY FOR AN ADJUSTABLE HEAD SECTION OF A FOLDABLE SOFA-SLEEPER FRAME

BACKGROUND OF THE INVENTION

This invention relates to a latch for positioning and releasably retaining articulated linkages such as the section angles in a combination sofa-sleeper having a foldable bed frame adapted to be collapsed and hidden in the bottom of a sofa when the unit is used for sitting and, more particularly, to a latch for positioning and releasably retaining the head section of the sofa-sleeper in a raised TV position.

Foldable sofa sleepers having pivotally interconnected head, body, intermediate, and foot sections movable between a fully folded or retracted position within the sofa frame and an extended position wherein the sections extend out and over the front rail of the sofa frame are known to the art. In such foldable sofa sleepers, in the extended position, the head, body, intermediate, and foot sections lie substantially coplanar one to the other providing a horizontal surface upon which a mattress is placed to provide a bed. It is further known in the art to provide such foldable sofa sleepers with means to independently tilt or otherwise adjust the head section to an inclined position without moving the body, intermediate, or foot sections to raise the head and shoulders of the user as is often desired for reading, viewing television, and the like. This position of the head section is sometimes referred to in the art as the "TV" position. In prior sofa-sleepers, the adjustable head section has been raised into the inclined position and supported, for example, by a manually releasable member such as a rotatable butterfly latch or in a Z-shaped slot. Representative of prior art patents illustrating the various attempts to provide an independently positionable head section are U.S. Pat. Nos. 3,165,757; 3,298,041; 3,395,409; 3,516,096; 3,868,733; 3,984,883; 4,104,745; and 4,253,205. As may be seen with reference to these patents, they require several additional mechanical elements to position and releasably latch the headrest in the TV position.

SUMMARY OF THE INVENTION

It has therefore been an objective of this invention to provide a foldable sofa-sleeper fixture having a head section releasably positionable in the TV position which is simple in construction and operation eliminating much of the complex mechanisms found in the prior art and which, in addition, provides for direct load bearing through a rigid link rather than through such mechanisms as a butterfly latch. This objective has been accomplished by providing the head section pivotally interconnected to a body section of a foldable sofa sleeper with a latch for releasably positioning the head section in the TV position which is relatively simple in construction requiring only a few parts but which provides for direct load bearing through a rigid link. This invention has thus eliminated the now widely used butterfly latch and other related support, control and stop linkages. The latch mechanism of the present invention further provides for substantial ease of operation. All in all, the mechanism is both simple in construction and more easily operable than those available in the prior art while providing direct load bearing for the head section.

In its general aspect, this invention is applicable to any system of linkages wherein it is desired to position and releasably retain one link pivotally connected to another in a desired angular relationship with respect to the other link. For example, the latch mechanism of the present invention is applicable to hinges such as those found on the hood of an automobile for positioning and releasably retaining the hood in an open position.

In its particular aspect and as related to a folding sofa-sleeper bed frame, this invention accomplishes the foregoing objectives by providing a connecting link pivotally connected at one end to the body section and having at its other end an elongated slot with a side portion providing a latching notch, and a latch plate slidably mounted on the connecting link and having an elongated slot overlying a portion of the slot of the connecting link. The latch plate slot likewise has a side portion as well as a guide edge extending between the rearward ends of the slot and side portion. The connecting link slot and latch plate slot make a lost motion connection with a pin fixed to the head section. The head section is sequentially movable between a lowered position wherein it is substantially coplanar with the body section, a set or latch "cocking" position, a TV position wherein the head section pin is captured in the locking notch, and a release position for removing the head pin from the locking notch and returning the head section to the lowered position.

In the lowered position, the latch plate is positioned rearwardly on the connecting link, and the head section is held in position by a stop provided by a heel on the head section angle engaging the forward end of the body section angle, and, in addition, by the connecting link engaging the top of one of the support levers. In this position, the elongated slot of the latch plate overlies a portion of the length of the elongated slot of the connecting link. However, the side portions of the slots are offset thus preventing entry of the head section pin into the latching notch in the connecting link. That is, the latch plate covers the latching notch. In the set or latch "cocking" position, the head section is raised by the user. On raising, the head section pin slides forwardly in the slot in the latch plate engaging its forward end. The engagement of the pin with the forward end of the latch plate causes the latch plate to slide forwardly on the connecting link until the head section pin engages a stop provided by the forward end of the elongated notch in the connecting link. This movement of the latch plate with respect to the connecting link slides the side portion of the slot of the latch plate over the side portion of the slot of the connecting link thus exposing the latching notch. On slight rearward movement of the head section, the head section pin moves rearwardly and the connecting link, pivoting about its forward pivot, falls by gravity to capture the head section pin in the latching notch. The rearward end of the latching notch in the connecting link engages the head section pin and directly bears the load on the head section. In this position, the head section is retained in the raised TV position.

To release the head section from the TV position, the user merely grasps the head section and pulls it forward slightly. In so doing, the head section pin engages the forward end of the side portion of the slot in the latch plate again sliding the latch plate forwardly on the connecting link. This movement continues until the head section pin engages the forward end of the side portion of the slot in the connecting link which provides a positive stop. On sliding of the latch plate forwardly on the connecting link, the guide edge in the latch plate which connects the rearward end of the slot side portion with the rearward end of the elongated slot in the latch plate is brought over the latching notch covering it and preventing the pin from entering it on rearward movement of the head section. Further, when the head section is pivoted downwardly, the guide edge guides the head section pin down into the elongated slots in the connecting link and latch plate where it engages the rearward end of the slot in the latch plate. On further downward movement or lowering the head section, the head section pin slides the latch plate rearwardly on the connecting link until the positive stop is reached by the head section heel engaging the forward end of the body section angle as described above. The head section has thus been returned to its lowered position whereby the sequence can be repeated.

It has been another objective of this invention to provide not only the above-described latch mechanism for positioning and releasably retaining the head section in a raised position but also one which permits the releasing of the connecting linkage from the head section and its subsequent reconnection without the use of tools or the removing or inserting of pins, bolts, or rivets to permit the head section to be folded forwardly onto the body section to make a compact package for shipping. That is, it has been recognized that a decrease in shipping space can be accomplished by folding the head section between the main body section and the folded short, intermediate, and foot sections to make a more compact package for shipping. Otherwise, the the head section extends above the top of the other sections when folded thereby requiring a larger shipping container resulting in a waste of space during shipping. However, in prior art attempts to solve this problem, it has always been necessary to provide some sort of removable fastening means, such as a rivet, to do so. This has required the user receiving the folded bed frame to insert the rivet back into the head section and secure it therein to make the bed frame operable. This has required additional effort on the part of the user and further requires the use of tools.

It has been a further objective of this invention to provide such a compact package for shipment but without requiring the removal of pins, bolts, rivets or their reinsertion by the user.

To this end, the sofa-sleeper of the present invention provides a transverse slot in both the latch plate and the connecting link which extends from the elongated slot in each member to the lower side edges of those members. These slots are wide enough to permit the head section pin to pass therethrough; however, they are normally out of alignment, i.e., they are offset with respect to each other, in all of the lowered, latch cocking, TV, and latch release positions. Rather, only in a position between the lowered position and the latch cocking position are they aligned. This invention allows the shipper to easily accomplish alignment of these slots which then permits him to grasp the connecting link and pivot it upwardly and forwardly to remove the head section pin from the connecting link and latch plate slots. This permits him to fold the head section onto the main body section for compact shipping. The user, on receiving the shipment, merely lifts the head section from the main body section, inserts the pin through the transverse slots and into the elongated slots, and then pushes the head section to its lowered position where the transverse slots are out of alignment and the head section is set for sequential positioning and release as set forth above. It will be appreciated that no tools are required, nor is it required to remove or to reinsert any bolts, pins, or rivets.

These and other objects and advantages of the present invention will be more readily apparent from the following detailed description of the invention taken with the accompanying drawings.

DETAILED DESCRIPTION OF THE INVENTION

General Description of the Sofa-Sleeper

Figure 1:
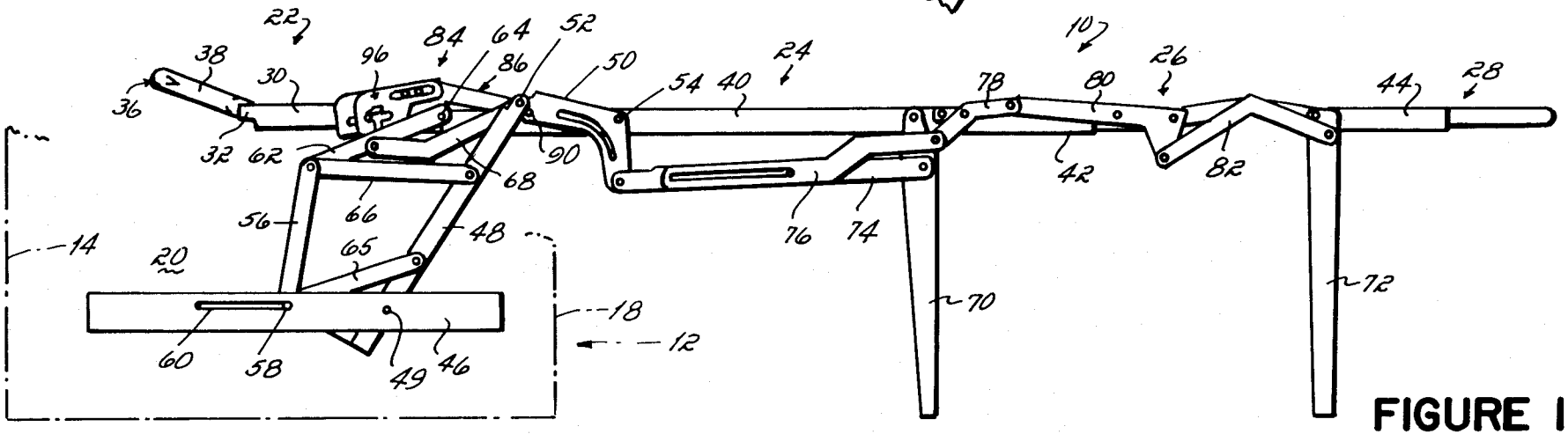
FIG. 1 is a side elevation view of a foldable sofa-sleeper fixture including the present invention, the sleeper being shown in the extended bed position.

Referring now to the drawings and particularly to FIG. 1, a sofa-sleeper frame 10 is illustrated as being mounted upon a frame 12 of an upholstered sofa which has a back 14, a fixed front rail 18, and a pair of side rails (not shown) extending between the back 14 and front rail 18 which define a generally rectangular storage enclosure 20 for the folded bed frame 10. The sofa itself does not form any part of the present invention and may comprise any well known standard upholstered frame construction. As used herein, the terms "front" or "forward" end of the bed reference that direction which is away from the sofa 12 while the terms "rear" and "rearward" refer to a direction which is toward the sofa 12.

The details of the sofa-sleeper frame 10 other than the latch mechanism described below are not critical, and the latch mechanism may be used on a variety of frame constructions. A presently preferred sofa-sleeper bed frame is shown in my U.S. Pat. No. 4,253,205, the disclosure of which is incorporated by reference, and those skilled in the art are referred to this patent for the details of the bed frame construction.

In general, however, the foldable sofa-sleeper frame 10 comprises a rear head section 22, a long intermediate or main body supporting section 24 pivotally connected at one end to the head section 22, a short intermediate section 26 pivotally connected at one end to the other end of the main body section 24, and a front foot section 28 pivotally connected to the other end of the short intermediate section 26. The head section 22 comprises similar symmetrically disposed left and right main angles 30 (only the left angle being shown in FIG. 1). As is conventional in the industry, the angles making up the frame have an outer vertical flange extending up from an outer edge of a lower inwardly extending flange. The rearward ends 32 of the side angles 30 of the head section 22 are interconnected by cross member 36 which comprises a transverse tubular member bent at its ends to form arms 38 which are riveted to adjacent ends 32 of the main angle 30.

The long intermediate or main body section 24, the short intermediate section 26, and the foot section 28 each comprise similar, symmetrically disposed left and right main angles 40, 42 and 44, respectively. As stated, the details of these sections form no part of the present invention and are described herein merely for purposes of illustrating a particularly useful environment of the present invention. The interconnected sections 22, 24, 26 and 28 together form a rectangular frame when the bed frame 10 is fully pulled out. As may be seen in FIG. 1, the sections lie in coplanar relation, i.e., they all lie in the same horizontal plane, and provide a resilient planar surface for supporting a mattress (not shown) in a bed extended or "sleeping" position.

The foldable frames on both sides of the bed making up the interconnected sections 24, 26 and 28 are similar and are symmetrically disposed. Since the means which connect the longitudinal portions of the bed on the right and left facing sides of the bed are similar and symmetrically disposed only the connections on one side are shown in the drawings. The side of the frame shown in FIGS. 2–6 is the left facing side of the bed which is the side on the left side of a person standing in front of the foot of the bed and looking toward to the head end of the bed.

The foldable bed frame 10 is mounted and supported at its forward end with respect to the sofa 12 by an anchor plate 46 secured to the side rail of the sofa frame 12 by suitable means such as bolts or screws (not shown). A front support lever 48 is pivotally connected at its base 49 to the anchor plate 46, and its upper end is pivotally connected to one arm of a bed lock plate 50 by a single rivet 52. The bed lock plate 50 is in turn pivotally connected to the main body section angle 40 by a single rivet 54. A rear support lever 56 has a pin 58 in its base making a sliding and pivoting connection with a slot 60 in the anchor plate 46. The upper end of the rear support lever 56 is pivotally connected to one end of an upper rear support lever 62, and the opposite end of the upper rear support lever 62 is pivotally connected to the rearwardmost end of the main body section angle 40 by means of a pivot pin 64 interconnecting the main body section angle 40 and the head section angle 30.

The front support lever 48 and rear support lever assembly 56, 62 serve to lift the main body section angle 40 out of the enclosure 20 of the sofa 12 and to project it and the sections articulated to it forwardly over the front rail 18. In the fully extended position shown in FIG. 1, the rear or head end of the main body section angle 40 is supported by these levers. A coil tension spring (not shown) is fixed at its rearward end to the anchor plate by a pin protruding from the anchor plate and at its forward end passes through a hole in an arm riveted to the front support lever 48 at a point below the fixed pivot 49. The spring biases the front support lever 48 to rotate about the pivot 49 which assists in opening the sofa sleeper unit and holds the frame in a partially open counterbalanced position. A guide link 65 pivotally connected to the pin 58 and to the front support lever 48 controls the movement of these levers on sliding of the pin 58 in the slot 60.

The upper end of the rear support lever 56 is connected to the front support lever 48 by a control link 66 which is pivotally connected at its forward end to the front support lever 46 and at its rearward end to the rear support lever 56 and the upper rear support lever 62. An actuating arm 68 interconnects the upper rear support lever 62, the front support lever 48, and the bed lock plate 50.

The remaining linkages are interconnected for lowering and raising a center leg 70 and front leg 72 supporting the main body section 24, short intermediate section 26, and foot section 28. These linkages include a center leg actuating arm 74 for actuating the center leg 70, a compression arm 76 connected through a bellcrank 78 and bellcrank actuating arm 80 to a front leg actuating arm 82 for actuating the front leg 72, the main body section 24, short intermediate section 26, and foot section 28 all being supported by the center leg 70 and front leg 72 in the bed open or horizontal position with the rear 56, 62 and front support levers 48, respectively, supporting the main body section 24 at its rearward end.

Detailed Description of Latch Mechanism

Figure 2:
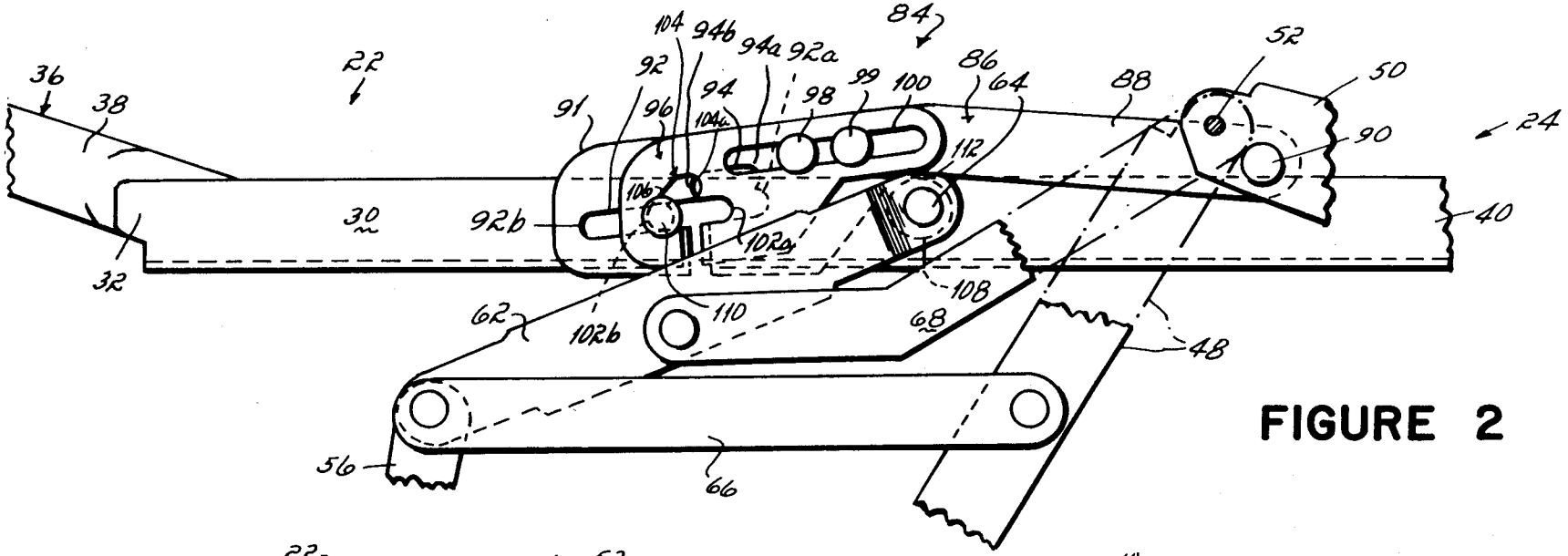
FIG. 2 is an enlargement of a portion of FIG. 1 showing a side view of portions of the head and main body sections and the latch mechanism of the present invention.
Figure 4:
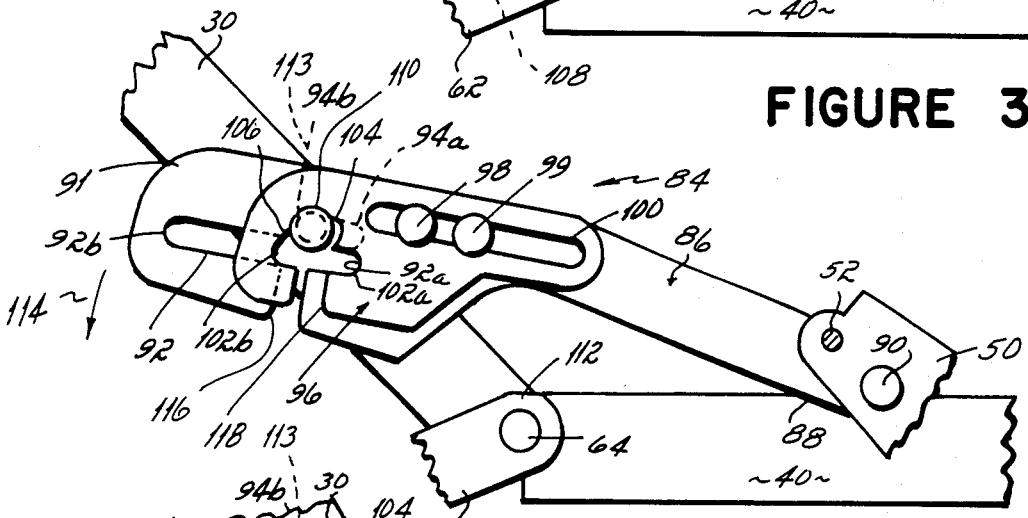
FIG. 4 is a view similar to FIG. 3 showing the latch mechanism in the latched, "in use," or raised TV position.

Referring now to FIG. 2, as described above, the section angle 30 of the head section 22 is pivotally connected at 64 to the rearwardmost end of the section angle 40 of the main body section 24. The head section 22 is pivotable about pivot pin 64 between a lowered position, as shown in FIGS. 1 and 2, where the head section 22 is substantially coplanar with the main body section 24 and a raised position as shown in FIG. 4 wherein the head section 22 is approximately at a 45° angle to the main body section angle 40. It is in this position as shown in FIG. 4 that the head section is latched in the TV position.

The latch 84 includes a connecting link 86 which is pivoted at its forward end 88 on a pivot pin 90 and is attached to the bed lock plate 50 on the side opposite that to which the front support lever 48 and actuating arm 68 are attached. The connecting link 86 includes at its rearward end 91 an elongated slot 92 having forward and rearward ends **92*a* and 92*b*, respectively, and having a upper side portion 94 of lesser length likewise having forward and rearward ends 94*a* and 94*b*, respectively. (See FIG. 2*a***).

A latch plate 96 is mounted to the connecting link 86 by means of a pair of studs 98 and 99 on the connecting link 86. The studs 98 and 99 make a lost motion connection in a slot 100 in the latch plate 96. The latch plate 96 further includes an elongated slot 102 having forward and rearward ends **102*a* and 102*b* and an upper side portion 104 likewise having a forward end 104*a*. A guide edge 106 extends between the upper side portion 104 and the rearward end 102*b* of the elongated slot 102. The slot 102 in the latch plate 96 is generally the same width as the slot 92 in the connecting link 86 but is of lesser length and, as shown in FIG. 2, lies rearwardly on the connecting link 86 in the lowered position of the head section 22**.

The head section angle 30 carries a pin 110 which extends through the slots 92 and 102 in the connecting link 86 and latch plate 86, respectively, making a lost motion connection therein.

As shown in FIG. 2 in the lowered position of the head section, the latch plate 96 is retracted on the connecting link 86. A heel 108 at the forward end of the head section angle 30 contacts the rearward end of the main body section angle 40 to hold the head section in its lowered or horizontal position. In addition, as shown most clearly in FIG. 2, the coincident bottom edges of the connecting link 86 and latch plate 96 bear against the upper end 112 of the upper rear support lever 62 providing maximum support for the head section 22 in the lowered position.

Operation of Latch Mechanism

Figure 3:
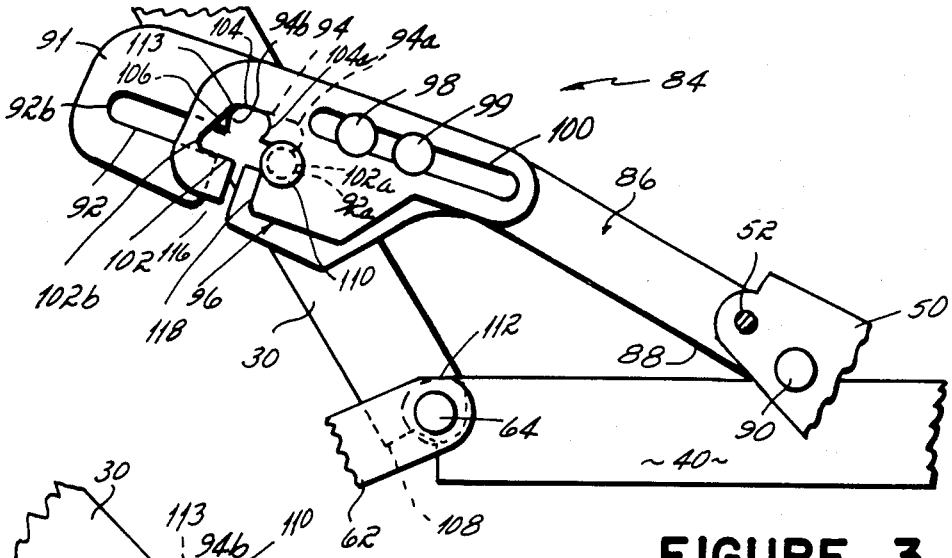
FIG. 3 is a side elevation view of the head and main body sections in a raised position to set or cock the latching mechanism.

When it is desired to move the head section to the raised or TV position, the user grasps the cross member 36 attached to the angle 30 and lifts the head section 22 upwardly pivoting it forwardly. The head section pin 110 makes a lost motion connection with the slot 102 in the sliding latch plate 96 such that on raising of the head section 110 the pin moves forwardly into engagement with forward end 102*a* of the slot 102 in the plate 96. On contacting the forward end 102*a* of the slot 102 in the latch plate, further pivotal movement of the head section causes the pin to slide the latch plate forwardly, as shown in FIG. 3, until the pin 110 engages the forward end 92*a* of the slot 92 in the connecting link 86 which provides a positive stop. In this position as shown in FIG. 3, the side portion 104 of the slot 102 in the latch plate 96 now overlies the side portion 94 in the slot 92 in the connecting link 86 to expose a latching notch 113 which is defined in the embodiment shown in the drawings as that portion of the side portion 94 of slot 92 lying between the rearward end 94*b* and the forward end 104*a* of slot side portion 104 when the latch plate 96 is in the ready or "cocked" position as best seen in FIG. 3.

On pivoting the head section rearwardly and downwardly, the connecting link 86 carrying the latch plate 96 also pivots downwardly by gravity about the pivot 90 (as shown by arrow 114 in FIG. 4). As this happens, the pin 110 slides along the upper edge of the slot 102 in the latch plate 96 until it is captured in the latching notch 113, in the position shown in FIG. 4. In this position, the rearward edge 94*b* of the slot 94 in the connecting link 86 provides a positive stop preventing the head section 22 from being lowered any farther. Thus, the user may rest against the head section 22 with his weight being supported by the head section pin 110 in the latching notch 113 bearing against surface 94*b*. It may be seen that this provides a strong support for the head section which is able to take considerable force without breakdown. In addition, the forward edge 104*a* of the side portion 104 of the slot 102 in the latch plate 96 tends to prevent the head section from accidentally tilting forward because of the relatively tight frictional engagement of the latch plate 96 on the connecting link 86. This will prevent the head section from accidentally flopping over, although as described below, the application of a moderate forward force to the head section will cause the latch plate 96 to slide forwardly on the connecting link 86.

In the presently preferred form of the invention as described above, the connecting link 86 pivots downwardly about pivot pin 90 by gravity on rearward movement of the head section from the "cocked" position to capture the head section pin 110 in the latching notch 113. Those skilled in the art will recognize, however, that means such as a spring, for example, could be used to positively urge the connecting link into position to capture the pin 110.

When it is desired to release the latch 84 to lower the head section 22, the user merely again grasps the head section 22 and pulls forwardly on it. By doing so, the head section pin 110 engages the forward edge 104*a* of the side portion 104 of the slot 102 in the latch plate 96 causing the latch plate to slide forwardly until the head section pin 110 contacts the forward edge 94*a* of the side portion 94 of the slot 92 in the connecting link 86 to provide a positive forward stop.

Figure 5:
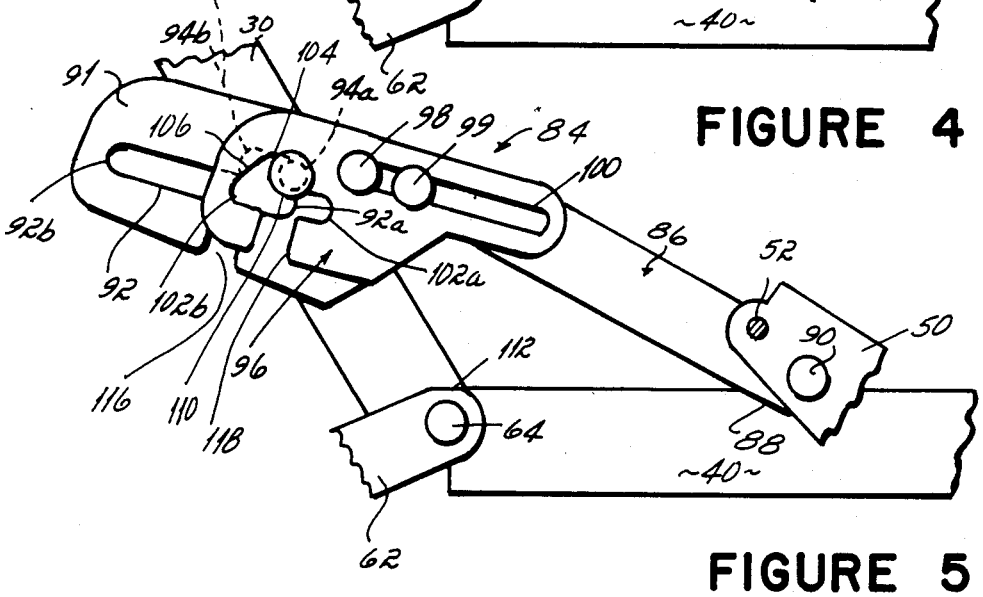
FIG. 5 is a view similar to FIGS. 3 and 4 showing the latch mechanism in the latch release position.

In this position, as shown in FIG. 5, which is the "latch release" position, the guide edge 106 now overlies the rearward portion of latching notch 113 including end 94*b* and, on rearward pivoting of the head section prevents the head section pin 110 from engaging the end 94*b* of the slot 94. Rather, the head section pin 110 follows the guide edge 106 down into the slot 102 in the latch plate 96 until it contacts the rearward end 102*b* of the slot 102. In this position, the pin 110 also rests in the elongated slot 92 in the connecting link 86, the guide edge 106 thus having guided the head section pin 110 downwardly from the latching notch 113 into the lower elongated slots 92 and 102 of the connecting link 86 and the latch plate 96, respectively. On further downward movement of the head section 22, the head section pin 110 being in engagement with the rearward end 104*b* of the elongated slot 104 in the latch plate 96 causes the latch plate to slide rearwardly on the connecting link 86 pulling the connecting link 86 and latch plate 96 combination downwardly until the head section 22 has been returned to its lowered position as shown in FIGS. 1 and 2. In this position, the head section is again in condition to be sequentially raised to the latched TV position and lowered again.

Detailed Description of Break Down Feature

Figures 2A, 6:
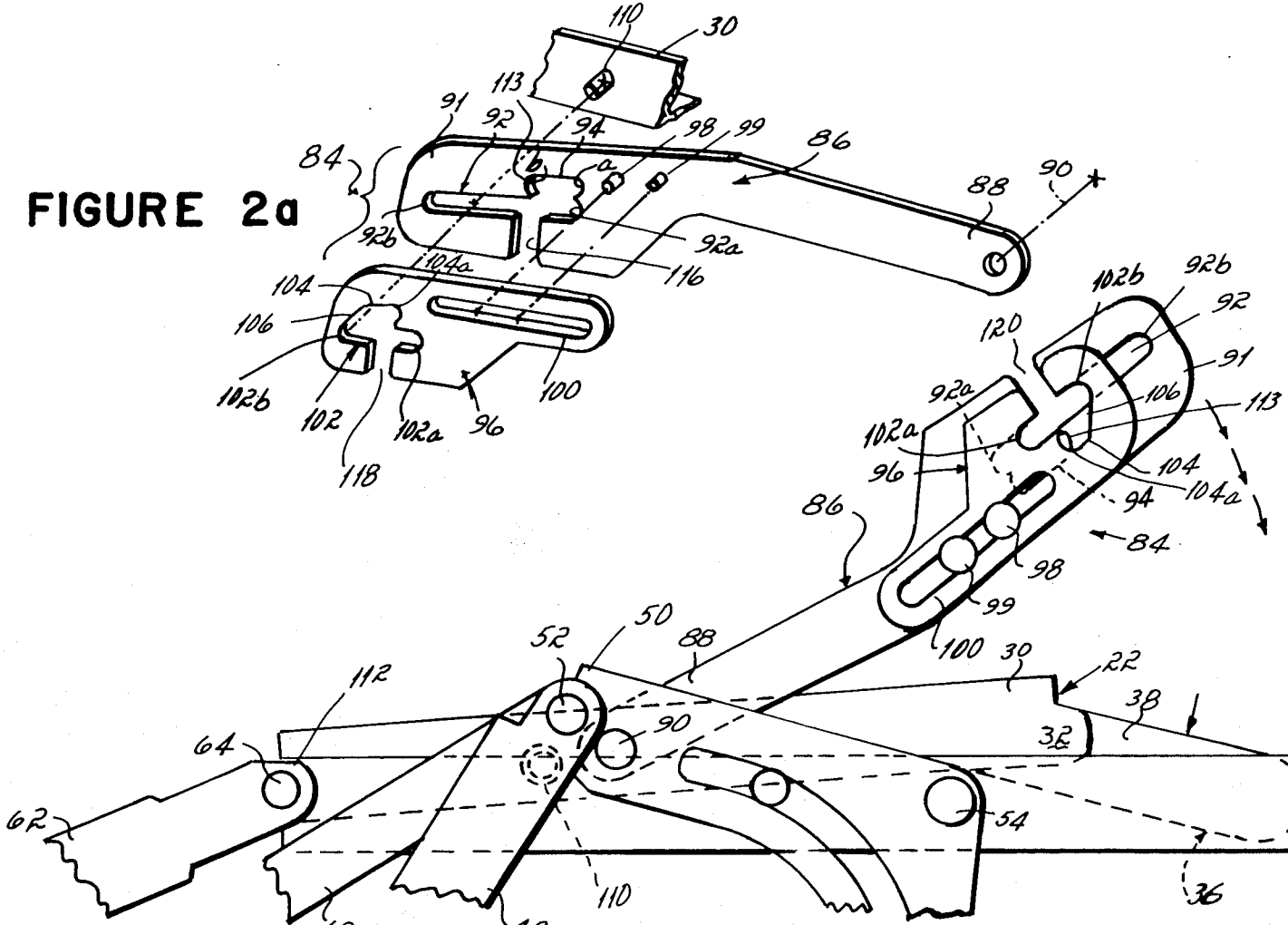
FIG. 2*a* is an exploded view of the latch mechanism shown in FIG. 2.
FIG. 6 is a side elevation view showing the head and body sections in the position where the head section pin has been removed from the slots of the latch mechanism, and the head section has been folded onto the body section for shipping of the folded frame.

One of the problems confronting this art has been to provide for break down of the head section 22 so that it could be pivoted forwardly onto the main body section 24 prior to folding of the bed frame 10 to provide a compact package for shipping of the frame 10 outside of the sofa frame. As will be noted by reference to FIGS. 2, 2*a* and 6, the lower edges of the connecting link 86 and latch plate 96 include transverse slots 116 and 118, respectively, which when aligned provide a space 120 through which the head section pin 110 can pass to remove the head section pin from the slots 92 and 102. This permits the manufacturer to grasp the head section 22 in the lowered position with one hand and the connecting link 86 with the other hand, raise the head section so that the pin 110 engages the forward end 102*a* of the slot 102 in the latch plate 96 causing the latch plate 86 to slide forwardly on the connecting link 96 until the transverse slots 116 and 118 are aligned. The manufacturer then pivots the connecting link upwardly whereby the pin 110 passes through the space 120 formed by aligning slots 116 and 118 to remove the head pin 110 from the slots 92 and 102 in the connecting link 86 and latch plate 96. With the pin 110 released, the head section 22 and the latch 87 may now be pivoted all the way forwardly onto the main body section 24 as shown in FIG. 6, and the foot 28 and short intermediate sections 26 folded to form a compact frame for shipment.

Once received, the user merely needs to unfold the articulated sections and then slip the head pin section 110 through the space 120 formed by the aligned slots 116 and 118 and into slots 92 and 102. Thus, it may be appreciated that it is not necessary to remove any pins, bolts, or rivets from down the head section-latch connection to permit pivoting of the head section onto to the main body section to form a compact package for shipping. Rather, the entire procedure can be accomplished by hand without the need for any tools.

The latch mechanism 84 as described above may be used on one side of the bed frame or an identical latch mechanism may be used on the other side of the bed frame to provide like latches on the left and right bed frame angle.

What is claimed is:

1. In a foldable sofa-sleeper bed frame including pivotally interconnected head and body sections, said head section being pivotal between (1) a lowered position coplanar with the body section, and (2) a raised position wherein said head section is at an angle to said body section, a latch for positioning and releasably retaining said head section in said raised portion comprising:

a connecting link pivotally connected at one end to said body section and having at the other end an elongated slot with a side portion providing a latching notch, a latch plate slidably mounted on said connecting link having an elongated slot overlying a portion of the slot of the connecting link and having a side notch portion extending from said latch plate elongated slot, and a linkage connection with said head section comprising a pin movable in said elongated slots, said side notch portion of said latch plate overlapping said slot of said connecting link in said raised position permitting said pin to be captured in said latch notch.

2. The latch of claim 1 wherein said pin makes a lost motion connection in said elongated slots.

3. The latching mechanism of claim 1 wherein said slot of said latch plate further comprises a guide edge operative to guide said pin out of said latching notch and into said elongated slots to permit return of said head section to said lowered position.

4. In a foldable sofa-sleeper bed frame including pivotally interconnected head and body sections, said head section being pivotal between (1) a lowered position coplanar with the body section, and (2) a raised position wherein said head section is at an angle to said body section, a latch for positioning and releasably retaining said head section in said raised position comprising:

a connecting link pivotally connected at one end to said body section and having at the other end an elongated slot with a side portion providing a latching notch, a latch plate slidably mounted on said connecting link and having an elongated slot of a length less than the length of the elongated slot of said connecting link and overlying a portion of the length of said elongated slot of said connecting link, said slot in said latch plate having a side notch portion adapted to overlie at least a portion of said side portion of said connecting link slot in said raised position, and a pin fixed to said head section and making a lost motion connnection in said elongated slots of said connecting link and said latch plate, said pin being operable on upward and forward movement of said head section from said lowered position toward said raised position to slide said latch plate on said connecting link such that said side notch portion of said latch plate slot overlies said side portion of said connecting link slot to expose said latching notch for receiving said pin on rearward movement of said head section.

5. The latch of claim 4 wherein said latch plate further comprises a guide edge extending between said side notch portion and said slot in said latch plate, said pin being operable to slide said latch plate on said connecting link to bring said guide edge over said latching notch to guide said pin from said latching notch to release said head section from said raised position.

6. The latch of claim 4 wherein said latching notch is defined by a rearward end of said side portion of said slot in said connecting link and a forward end of said side notch portion of said slot in said latch plate.

7. In a foldable sofa-sleeper bed frame including pivotally interconnected head and body sections, said head section being pivotable sequentially between a lowered position coplanar with said body section, a latch cocking position, a raised position wherein said head section is at an angle to said body section, and a latch release position, a latch for positioning and releasably retaining said head section in said raised position comprising:

a connecting link pivotally connected at one end to said body section and having at the other end an elongated slot with a first side notch portion, said elongated slot and said first side notch portion each having forward and rearward ends, a latch plate slidably mounted on said connecting link having an elongated slot of a length less than the length of the elongated slot of said connecting link and overlying a portion of the elongated slot of the connecting link, said latch plate slot having a second side notch portion adapted to overlap at least a portion of said first side notch portion of said connecting link slot in said raised position, said latch plate elongated slot and said second side notch portion each having forward and rearward ends, and having a guide edge connecting the rearward end of said second side notch portion with the rearward end of the elongated slot, and a pin making a lost motion connection in said connecting link and latch plate slots, said pin engaging the rearward end of said connecting link slot in said lowered position to hold said head section in said lowered position, said pin being adapted to engage the forward end of the latch plate slot on raising of the head section to slide said latch plate on said connecting link until said pin is stopped by the forward end of the elongated connecting link slot in the latch cocking position, said second side notch portion of said latch plate slot overlying a portion of said first side notch portion of said connecting link slot to define a latching notch between the rearward end of said first side notch portion of said connecting link slot and the forward end of said second side notch portion of said latch plate slot, said connecting link with latch plate thereon being adapted to pivot on rearward movement of said head section to thereby capture said pin in said latching notch in said raised position, said pin bearing against the rearward end of said first side notch portion of said connecting link slot and said head section being supported thereby in said raised position, said pin further making a lost motion connection in said first side notch portion of said connecting link slot and being further adapted to engage the forward end of said second side notch portion of said latch plate slot on raising of the head section to slide said latch plate forwardly on said connecting link until said pin is stopped by the forward edge of said first side notch portion of said connecting link slot and being operable to guide said pin into said elongated slots of said connecting link and latch plate on downward movement of siad head section from said latch release position, said pin engaging the rearward end of said slot of said latch plate and being operable to slide it rearwardly on said connecting link to said lowered position.

8. The latch of claim 7 further comprising a first slot extending between a side edge and said elongated slot of said connecting link and a second slot extending between a side edge and said elongated slot of said latch plate, said first and second slots being adapted to be aligned to permit removal of said pin from said latch to permit pivoting of said head section onto said body section to form a compact folded bet frame for shipping.

9. The latch of claim 8 wherein said slots are adapted to be aligned in a position between said lowered position and said latch cocking position but non-aligned in each of said lowered, latch cocking, raised and latch release positions.

10. The latch of claim 7 wherein said latch plate is mounted to said connecting link by means of a pair of studs on one of said members making a lost motion connection in slots on the other of said members.

11. The latch of claim 7 wherein said connecting link with latch plate thereon pivots from said latch cocking position to said raised position by the force of gravity.

12. The latch of claim 7 further comprising means to pivot said connecting link with latch plate thereon from said latch cocking position to said raised position.

13. In a foldable sofa-sleeper bed frame including pivotally interconnected head and body sections, said head section being pivotal between (1) a lowered position coplanar with the body section, and (2) a raised position wherein said head section is at an angle to said body section, a connecting link pivotally connected at one end to said body section and having at the other end an elongated slot with a side portion providing a latching notch, a latch plate slidably mounted on said connecting link and having an elongated slot of a length less than the length of the elongated slot of said connecting link and overlying a portion of the length of said elongated slot of said connecting link, said slot in said latch plate having a side notch portion adapted to overlie at least a portion of said side portion of said connecting link slot in said raised position, and a pin fixed to said head section and making a lost motion connection in said elongated slots of said connecting link and said latch plate, the method of sequentially positioning and releasably retaining said head section in said raised position comprising the steps of:

pivoting said head section upwardly to cause said pin to slide said latch plate on said connecting link such that said side notch portion of said latch plate slot overlies said side portion of said connecting link slot to expose said latching notch for receiving said pin, pivoting said head section downwardly to cause said latching notch to capture said pin, pivoting said head section upwardly to release said pin from said latching notch, and pivoting said head section downwardly to return said head section to said lowered position.

* * * * *

UNITED STATES PATENT AND TRADEMARK OFFICE

CERTIFICATE OF CORRECTION

PATENT NO. : 4,669,134

DATED : June 2, 1987

INVENTOR(S) : Aloysius J. Mikos

It is certified that error appears in the above-identified patent and that said Letters Patent is hereby corrected as shown below:

Column 9, line 16, change "portion" to --position--.

Column 11, line 5, change "siad" to --said--.

Column 11, line 18, change "bet" to --bed--.

Signed and Sealed this

Twenty-ninth Day of November, 1988

*Attest:*

DONALD J. QUIGG

*Attesting Officer*

*Commissioner of Patents and Trademarks*